US009677812B1

(12) United States Patent
Joyner

(10) Patent No.: US 9,677,812 B1
(45) Date of Patent: Jun. 13, 2017

(54) CLOTHES DRYER VENT AIRFLOW SYSTEM

(71) Applicant: Jimmy Joyner, McDonough, GA (US)

(72) Inventor: Jimmy Joyner, McDonough, GA (US)

( * ) Notice: Subject to any disclaimer, the term of this patent is extended or adjusted under 35 U.S.C. 154(b) by 592 days.

(21) Appl. No.: 14/258,126

(22) Filed: Apr. 22, 2014

(51) Int. Cl.
*F24F 7/06* (2006.01)
*F26B 21/10* (2006.01)

(52) U.S. Cl.
CPC ..... *F26B 21/10* (2013.01)

(58) Field of Classification Search
CPC ..... F26B 21/10; D06F 58/20
USPC ..... 454/341
See application file for complete search history.

(56) References Cited

U.S. PATENT DOCUMENTS

D151,311 S 3/1945 Zeiler et al.
4,922,808 A * 5/1990 Smith ..... E02D 31/008 165/909
5,628,122 A * 5/1997 Spinardi ..... D06F 58/22 137/132
5,860,858 A * 1/1999 Wettergren ..... D06F 58/20 34/235
6,230,418 B1 * 5/2001 Gomulinski ..... D06F 58/04 285/181
6,378,227 B1 * 4/2002 Bradford ..... D06F 58/04 34/235
6,637,127 B2 * 10/2003 Reede ..... D06F 58/22 34/140
8,011,114 B2 * 9/2011 Johnson ..... F26B 21/001 15/300.1
8,256,133 B2 * 9/2012 Asciolla ..... D06F 58/20 34/140
8,528,226 B2 9/2013 Bache et al.
9,103,589 B2 * 8/2015 Sullivan ..... F26B 25/009
2002/0023368 A1 * 2/2002 Beaumont ..... D06F 58/22 34/79
2007/0124953 A1 6/2007 Crnkovich
2008/0005926 A1 * 1/2008 Goggin ..... D06F 58/20 34/605
2010/0000118 A1 * 1/2010 Cunningham ..... D06F 58/20 34/487
2011/0048330 A1 * 3/2011 Mathews ..... A01K 1/0107 119/165
2012/0067377 A1 * 3/2012 Lee ..... C02F 1/00 134/22.12
2013/0219735 A1 * 8/2013 Beaumont ..... F26B 21/003 34/82
2014/0082956 A1 * 3/2014 Sullivan ..... F26B 25/009 34/82

FOREIGN PATENT DOCUMENTS

WO WO 2013131184 9/2013

* cited by examiner

*Primary Examiner* — Steven B McAllister
*Assistant Examiner* — Jonathan Cotov

(57) ABSTRACT

The clothes dryer vent airflow system is configured to work in between an exhaust port of an existing clothes dryer and an exhaust line that extends outside of a dwelling. The clothes dryer vent airflow system includes a fan housing that includes a dryer exhaust port on a first side while an intake port and fan housing exhaust port are provided on a second side of the fan housing. The fan housing includes a fan therein, which is adapted to receive accelerated clothes dryer exhaust air from the clothes dryer via the dryer exhaust port as well as ambient air via the intake port.

8 Claims, 6 Drawing Sheets

CLOTHES DRYER VENT AIRFLOW SYSTEM

CROSS REFERENCES TO RELATED APPLICATIONS

Not Applicable

STATEMENT REGARDING FEDERALLY SPONSORED RESEARCH

Not Applicable

REFERENCE TO APPENDIX

Not Applicable

BACKGROUND OF THE INVENTION

A. Field of the Invention

The present invention relates to the field of dryer vent accessories, more specifically, a clothes dryer vent accessory that is adapted for use in accelerating the clothes dryer exhausting process.

SUMMARY OF THE INVENTION

An embodiment of the disclosure meets the needs presented above by generally comprising a clothes dryer vent airflow system that is configured to work in between an exhaust port of an existing clothes dryer and an exhaust line that extends outside of a dwelling. The clothes dryer vent airflow system includes a fan housing that includes a dryer exhaust port on a first side while an intake port and fan housing exhaust port are provided on a second side of the fan housing. The fan housing includes a fan therein, which is adapted to receive accelerated exhaust port as well as ambient air via the intake port. The fan accelerates and mixes both the ambient air and the accelerated clothes dryer exhaust air before transferring said air mixture to the fan housing exhaust port where a clothes dryer exhaust line is adaptively affixed, and which transmits said air mixture away there from. The dryer exhaust port of the fan housing includes a pressure switch that insures that the fan housing is securely affixed to a clothes dryer exhaust pipe. The dryer exhaust port of the fan housing includes a smoke detector. Both the pressure switch and the smoke detector are in wired communication with a circuit breaker provided on a modified clothes dryer electrical plug. The circuit breaker can cease operation of both the clothes dryer and a motor connected to the fan in the fan housing thereby ceasing operation of the clothes dryer and the clothes dryer vent airflow system. The modified clothes dryer electrical plug includes a female electrical outlet that is provided to connect a male electrical cord that is wired to the motor of the fan housing.

An object of the invention is to provide a system that handles exhausted air from a clothes dryer, and mixes said exhaust air with ambient air in order to lower the resulting temperature, and then accelerate said air to a clothes dryer exhaust line in order to safely exhaust said mixed air to an outside location.

A further object of the invention is for the fan and fan housing to have the opportunity to further accelerate the exhausted air from the clothes dryer in order to prevent lint accumulation.

A further object of the invention is for a modified clothes dryer electrical plug to be configured to attach in between the electrical panel of the clothes dryer and a high voltage electrical receptacle.

An even further object of the invention is for the modified clothes dryer electrical plug to include a circuit breaker that is attached to a pressure sensor on the dryer exhaust port of the fan housing so as to insure a secure connection of the fan housing with the clothes dryer exhaust pipe, and turn off power to both the clothes dryer and the motor of the fan housing when the pressure sensor is not made.

An even further object of the invention is for the modified clothes dryer electrical plug to connect the circuit breaker to a smoke detector located in the dryer exhaust port of the fan housing so as to turn off electrical power to the clothes dryer and the motor of the fan housing upon detection of smoke.

An even further object of the invention is for the modified clothes dryer electrical plug to include a female electrical outlet that is able to connect with a male electrical plug that is connected to the motor of the fan housing so as to provide electrical power to the invention.

These together with additional objects, features and advantages of the clothes dryer vent airflow system will be readily apparent to those of ordinary skill in the art upon reading the following detailed description of presently preferred, but nonetheless illustrative, embodiments of the clothes dryer vent airflow system when taken in conjunction with the accompanying drawings.

In this respect, before explaining the current embodiments of the clothes dryer vent airflow system in detail, it is to be understood that the clothes dryer vent airflow system is not limited in its applications to the details of construction and arrangements of the components set forth in the following description or illustration. Those skilled in the art will appreciate that the concept of this disclosure may be readily utilized as a basis for the design of other structures, methods, and systems for carrying out the several purposes of the clothes dryer vent airflow system.

It is therefore important that the claims be regarded as including such equivalent construction insofar as they do not depart from the spirit and scope of the clothes dryer vent airflow system. It is also to be understood that the phraseology and terminology employed herein are for purposes of description and should not be regarded as limiting.

BRIEF DESCRIPTION OF THE DRAWINGS

The disclosure will be better understood and objects other than those set forth above will become apparent when consideration is given to the following detailed description thereof. Such description makes reference to the annexed drawings wherein.

DETAILED DESCRIPTION OF THE EMBODIMENT

Figure 1:
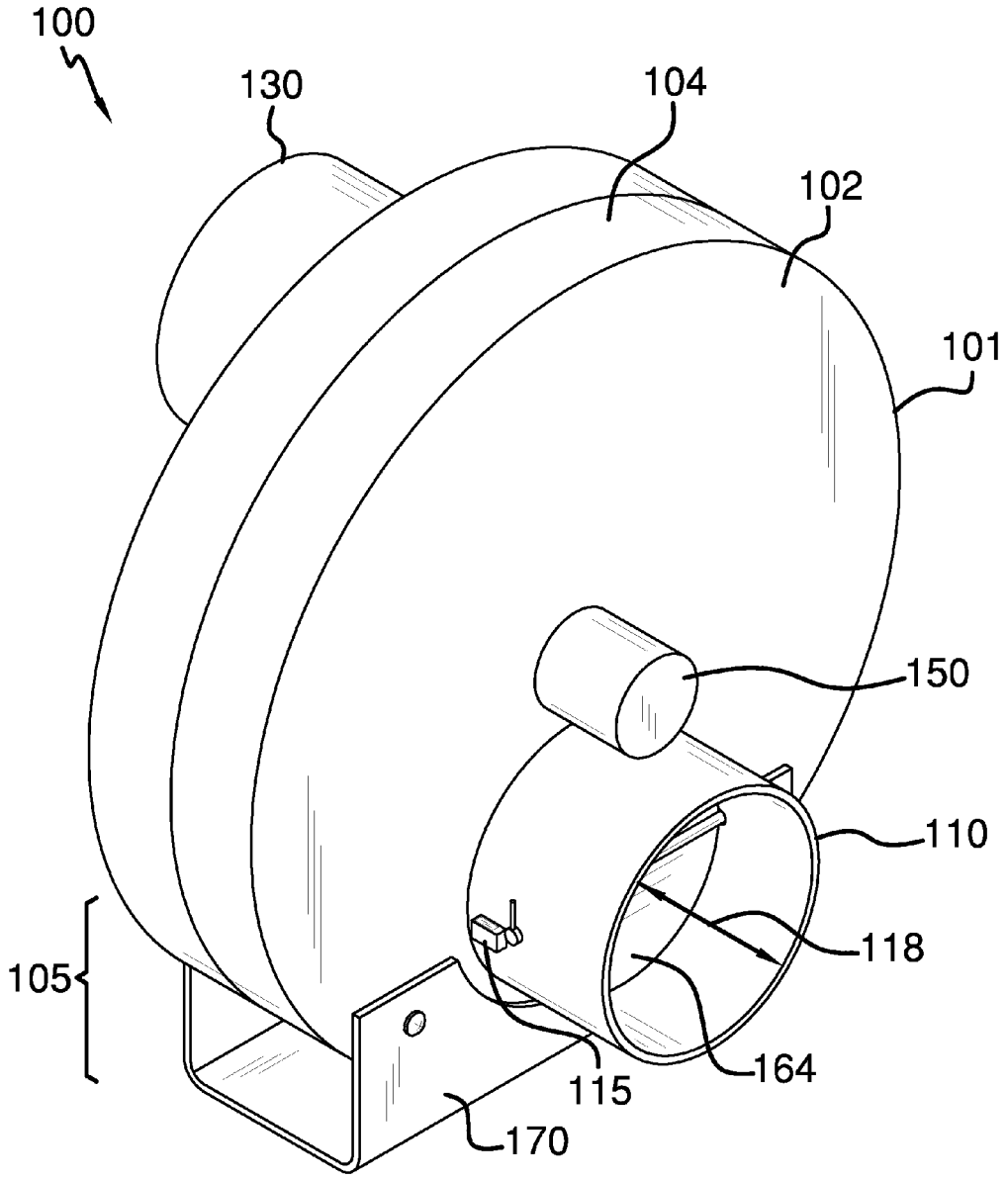
FIG. 1 is a perspective view of the fan housing by itself.
Figure 3:
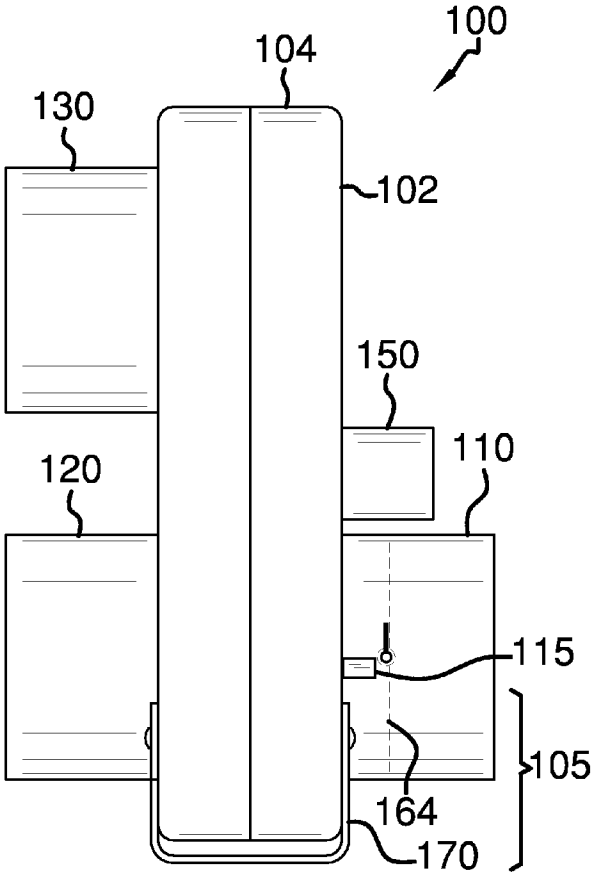
FIG. 3 is a profile view of the fan housing.

The following detailed description is merely exemplary in nature and is not intended to limit the described embodiments of the application and uses of the described embodiments. As used herein, the word "exemplary" or "illustrative" means "serving as an example, instance, or illustration." Any implementation described herein as "exemplary" or "illustrative" is not necessarily to be construed as preferred or advantageous over other implementations. All of the implementations described below are exemplary implementations provided to enable persons skilled in the art to practice the disclosure and are not intended to limit the scope of the appended claims. Furthermore, there is no intention to be bound by any expressed or implied theory presented in the preceding technical field, background, brief summary or the following detailed description.

As best illustrated in FIGS. 1 through 6, a clothes dryer vent airflow system 100 (hereinafter invention) includes a fan housing 101 that is a cylindrical-shaped body further defined with a first side 102 and a second side 103 as well as a peripheral surface 104. The first side 102 of the fan housing 101 includes a dryer exhaust port 110 and a motor 150; whereas the second side 103 of the fan housing 101 includes an ambient air intake port 120 and a fan housing exhaust port 130. The dryer exhaust port 110, the ambient air intake port 120, and the fan housing exhaust port 130 are cylindrically shaped protuberances that extend perpendicularly away from the first side 102 and the second side 103, respectively.

Figure 2:
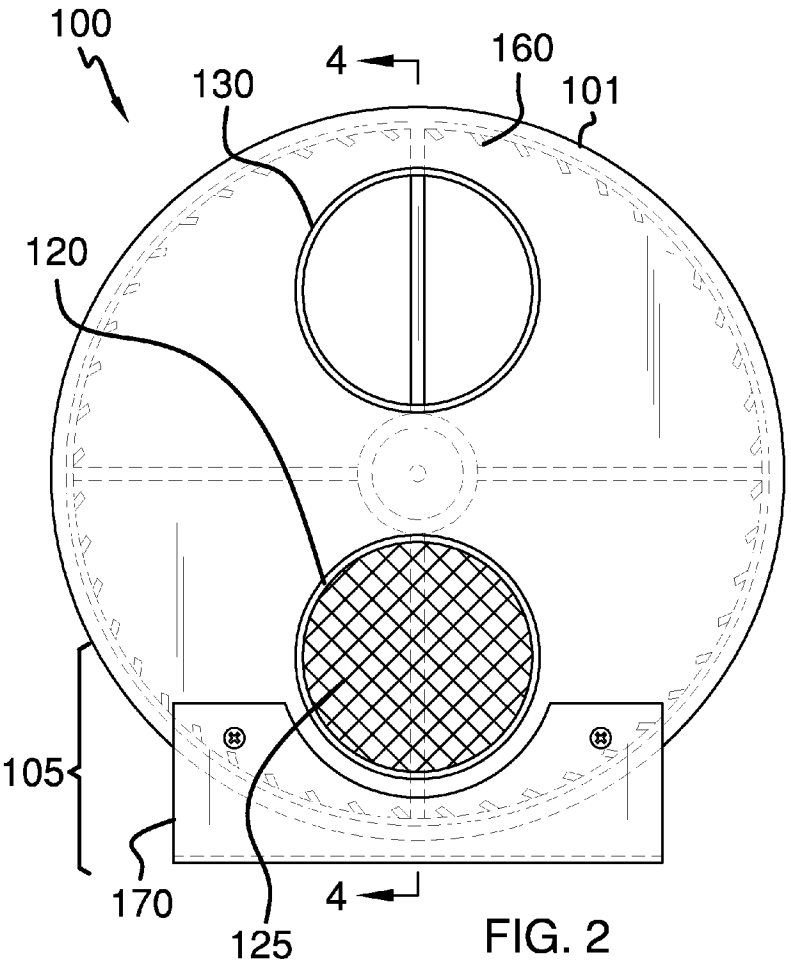
FIG. 2 is a front view of the second side of the fan housing.
Figure 4:
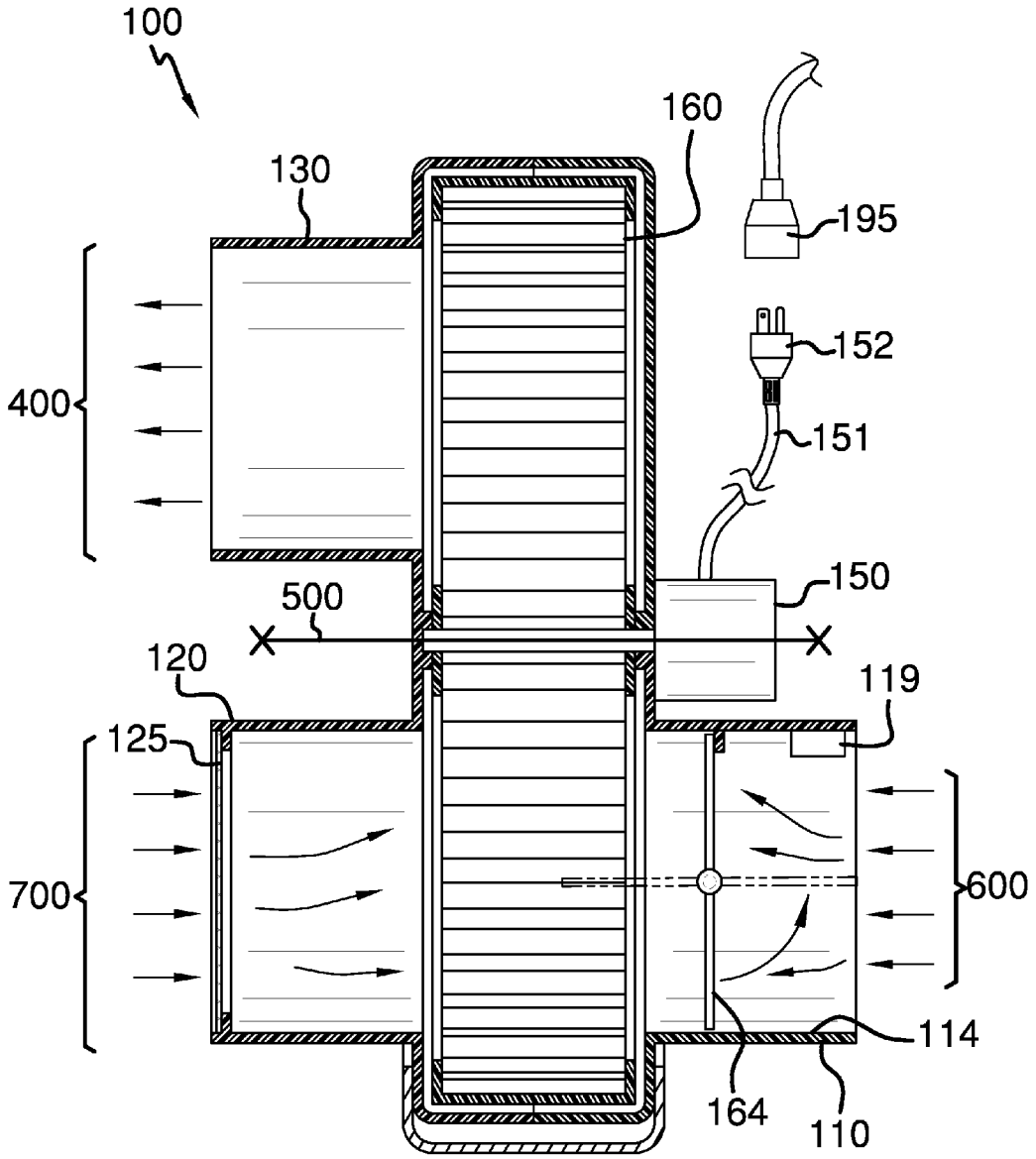
FIG. 4 is a cross-sectional view along line 4-4 in FIG. 2.
Figure 5:
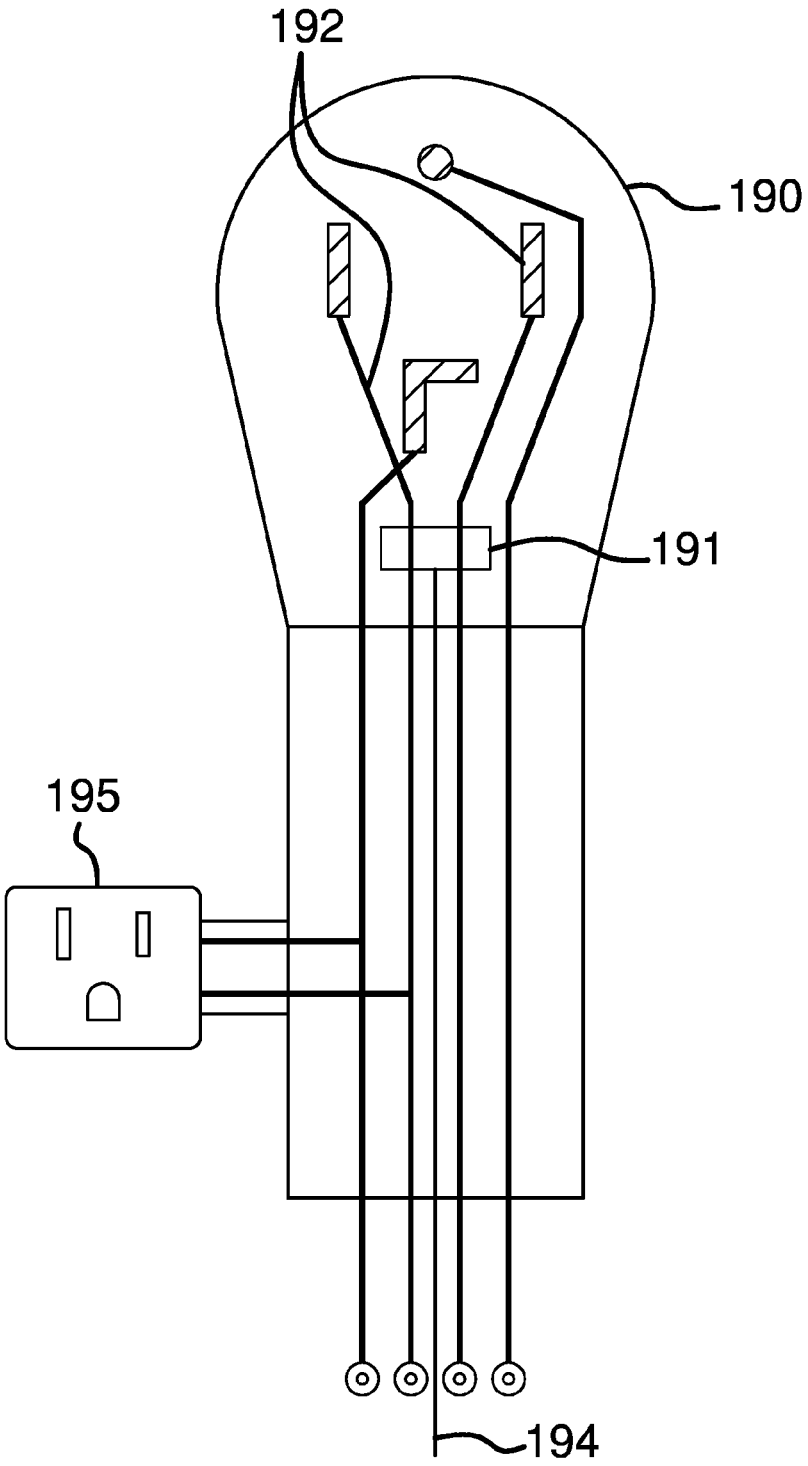
FIG. 5 is an electrical diagram of the modified clothes dryer electrical plug.
Figure 6:
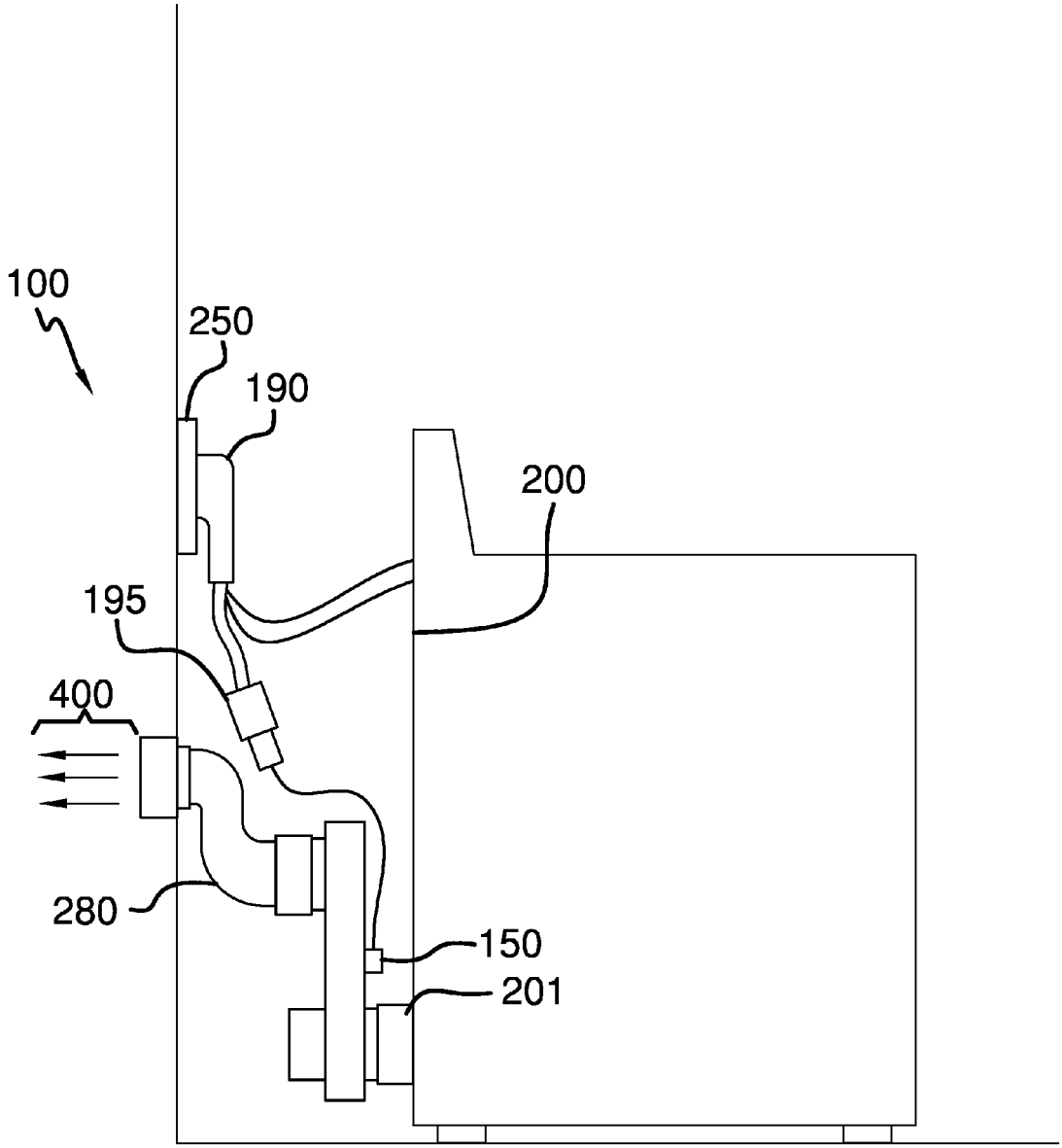
FIG. 6 is a view of the assembly in use with a clothes dryer and electrical receptacle.
Figure 7:
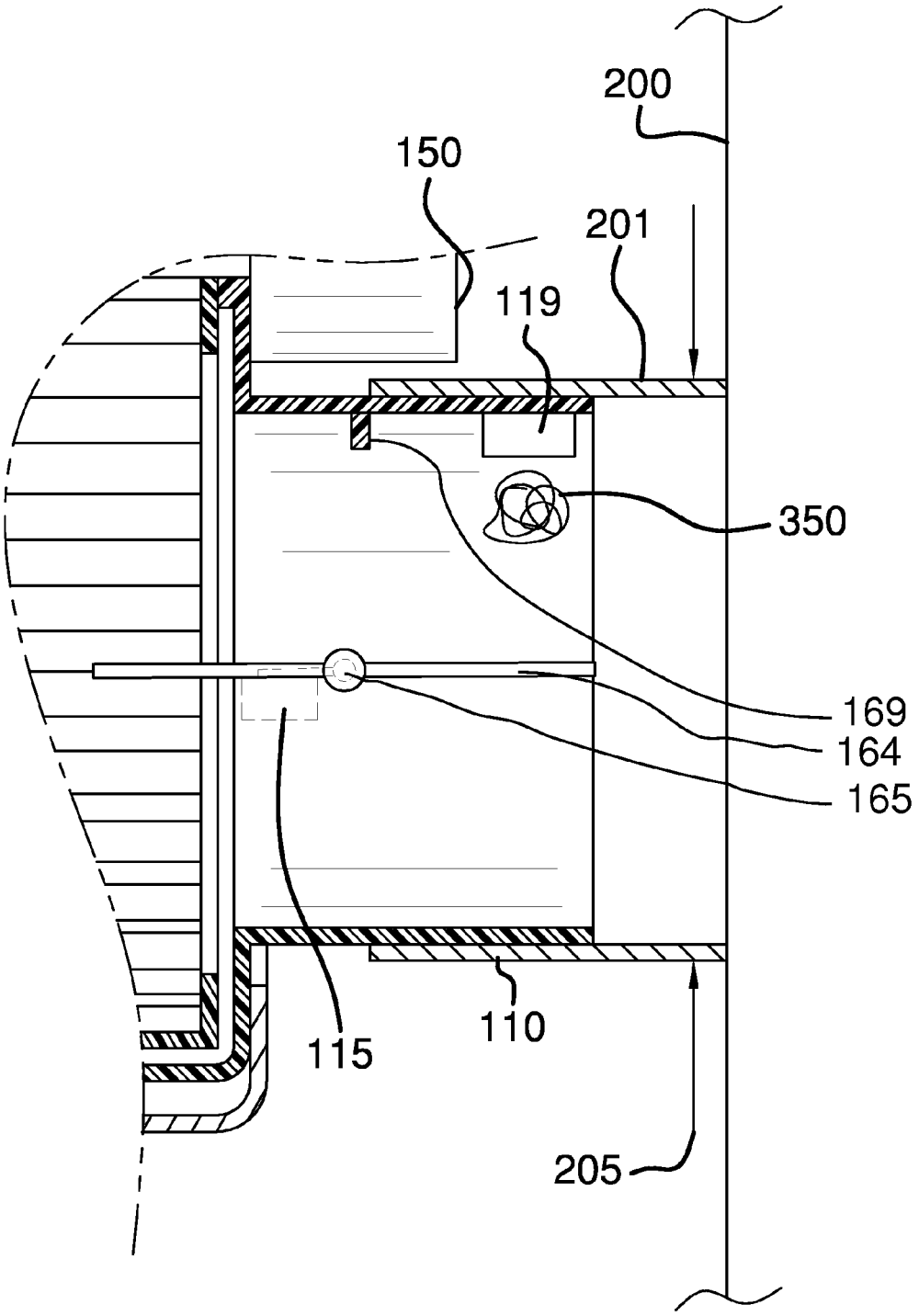
FIG. 7 is a detailed view of the clothes dryer exhaust pipe secured to the dryer exhaust port of the fan housing.

Referring to FIG. 2, the motor 150 is connected to an impeller 160 that is located inside of the fan housing 101. Moreover, the impeller 160 is able to rotate about a horizontal axis 500 in order to draw in air from both the dryer exhaust port 110 and the ambient air intake port 120. The impeller 160 mixes and accelerates air from the dryer exhaust port 110 and the ambient air intake port 120, and dispenses mixed air 400 out the fan housing exhaust port 130. The fan housing exhaust port 130 is configured to attach to a clothes dryer exhaust line 280. The clothes dryer exhaust line 280 is able to exhaust the mixed air 400 elsewhere. Moreover, clothes dryer exhaust 600 is blown into the dryer exhaust port 110; whereas ambient air 700 is sucked into the ambient air intake port 120. The ambient air intake port 120 may include a screen member 125 that is used to screen the ambient air 700 prior to entering the fan housing 101.

The fan housing 101 may include a stand member 170 that is affixed to a bottom portion 105 of the fan housing 101. The stand member 170 is optionally provided in order to stabilize the invention 100 adjacent to an existing clothes dryer 200.

The existing clothes dryer 200 is configured to be used with the invention 100. More specifically, the existing clothes dryer 200 includes a clothes dryer exhaust pipe 201 that is configured to attach to the dryer exhaust port 110 of the fan housing 101. The dryer exhaust port 110 is a cylindrically-shaped protuberance that extends from the first side 102 of the fan housing 101. The dryer exhaust port 110 includes a pressure sensor 115 that is provided on an inner surface 114 of the dryer exhaust port 110. The pressure sensor 115 is used to insure that the clothes dryer exhaust pipe 201 is secured and inserted an exhaust pipe depth 117 into the dryer exhaust port 110. That being said, the dryer exhaust port 110 has an internal diameter 118 that is greater than or equal to a clothes dryer exhaust pipe outer diameter 205.

The clothes dryer 200 requires electricity in order to operate. A modified clothes dryer electrical plug 190 is included with the invention 100. The modified clothes dryer electrical plug 190 is configured to connect to an electrical receptacle 250. The modified clothes dryer electrical plug 190 includes a circuit breaker 191 that is provided in-line with dryer plug leads 192 in order to cut off electrical connectivity between the electrical receptacle 250 and the clothes dryer 200 when certain emergency situations arise. The invention 100 includes a smoke detector 119 on the inner surface 114 of the dryer exhaust port 110 in order to detect any smoke that may arise with burning lint 350 that collects outside of the clothes dryer 200, which is a known fire hazard. Moreover, the smoke detector 119 along with the pressure sensor 115 are collectively wired to the circuit breaker 191 via a sensor wire 194, and either of which may trip the circuit breaker 191 in order to cut off electrical flow from the electrical receptacle 250 to the clothes dryer 200.

Referring to FIG. 4B, the dryer exhaust port 110 shall also include an air velocity sensor 164 that includes a spring-loaded hinge 165, and an on/off wire 166. The on/off wire 166 connects to the motor 150 and turns on or off the motor 150 depending upon the presence of clothes dryer exhaust 600 being present. The air velocity sensor 164 pivots with respect to the spring-loaded hinge 165 in order to open or close off the dryer exhaust port 110. If the clothes dryer exhaust 600 is entering the dryer exhaust port 110, the air velocity sensor 164 will rotate horizontally, and upon doing so shall turn on the motor 150 via the on/off wire 166. The air velocity sensor 164 is essentially a baffle that rotates dependent upon whether clothes dryer exhaust 600 is entering or not. The air velocity sensor 164 rotates from a vertical position to a horizontal position. Moreover, an air velocity sensor catch 169 is included in the inner surface 114 of the dryer exhaust port 110, and limits the operational range of rotational movement of the air velocity sensor 164.

Moreover, the modified clothes dryer electrical plug 190 includes a female electrical outlet 195, which is able to connect with a male plug 152 of a motor electrical cord 151 of the motor 150. The modified clothes dryer electrical plug 190 is able to supply electricity to both the clothes dryer 200 as well as the motor 150.

With respect to the above description, it is to be realized that the optimum dimensional relationship for the various components of the invention 100, to include variations in size, materials, shape, form, function, and the manner of operation, assembly and use, are deemed readily apparent and obvious to one skilled in the art, and all equivalent relationships to those illustrated in the drawings and described in the specification are intended to be encompassed by the invention 100.

It shall be noted that those skilled in the art will readily recognize numerous adaptations and modifications which can be made to the various embodiments of the present invention which will result in an improved invention, yet all of which will fall within the spirit and scope of the present invention as defined in the following claims. Accordingly, the invention is to be limited only by the scope of the following claims and their equivalents.

What is claimed is:

1. A clothes dryer vent airflow system comprising:

a fan housing with a dryer exhaust port configured to attach to a clothes dryer exhaust pipe of a clothes dryer;

said fan housing also includes an ambient air intake port that is configured to draw in ambient air and mix said ambient air with clothes dryer exhaust thereby lowering the overall temperature and forming a mixed air that is dispensed from the fan housing via a fan housing exhaust port;

wherein said fan housing exhaust port is configured to attach to a clothes dryer exhaust line that dispenses the mixed air elsewhere;

wherein the fan housing is a cylindrical-shaped body further defined with a first side and a second side as well as a peripheral surface;

wherein the first side of the fan housing includes the dryer exhaust port and a motor;

wherein the second side of the fan housing includes the ambient air intake port and the fan housing exhaust port;

wherein the dryer exhaust port, the ambient air intake port, and the fan housing exhaust port are cylindrically shaped protuberances that extend perpendicularly away from the first side and the second side, respectively;

wherein the motor is connected to an impeller that is located inside of the fan housing;

wherein the impeller is able to rotate about a horizontal axis in order to draw in air from both the dryer exhaust port and the ambient air intake port;

wherein the impeller mixes and accelerates air from the dryer exhaust port and the ambient air intake port, and dispenses the mixed air out the fan housing exhaust port;

wherein the clothes dryer exhaust is blown into the dryer exhaust port;

whereas ambient air is sucked into the ambient air intake port;

wherein the dryer exhaust port is a cylindrically-shaped protuberance that extends from the first side of the fan housing;

wherein the dryer exhaust port includes a pressure sensor that is provided on an inner surface of the dryer exhaust port;

wherein the pressure sensor is used to insure that the clothes dryer exhaust pipe is secured and inserted an exhaust pipe depth into the dryer exhaust port;

wherein the dryer exhaust port has an internal diameter that is greater than or equal to a clothes dryer exhaust pipe outer diameter;

wherein a modified clothes dryer electrical plug is included, and is configured to connect to an electrical receptacle;

wherein the modified clothes dryer electrical plug includes a circuit breaker that is provided in-line with at least two dryer plug leads in order to cut off electrical connectivity between the electrical receptacle and the clothes dryer when certain emergency situations arise.

2. The clothes dryer vent airflow system according to claim 1 wherein the ambient air intake port includes a screen member that is used to screen the ambient air prior to entering the fan housing.

3. The clothes dryer vent airflow system according to claim 1 wherein the fan housing includes a stand member that is affixed to a bottom portion of the fan housing; wherein the stand member is optionally provided in order to stabilize the fan housing adjacent to an existing clothes dryer.

4. The clothes dryer vent airflow system according to claim 1 wherein a smoke detector is included on the inner surface of the dryer exhaust port in order to detect any smoke that may arise with burning lint that collects outside of the clothes dryer.

5. The clothes dryer vent airflow system according to claim 4 wherein the smoke detector along with the pressure sensor are collectively wired to the circuit breaker via a sensor wire, and either of which may trip the circuit breaker in order to cut off electrical flow from the electrical receptacle to the clothes dryer; wherein the modified clothes dryer electrical plug includes a female electrical outlet, which is able to connect with a male plug of a motor electrical cord of the motor such that the modified clothes dryer electrical plug is able to supply electricity to both the clothes dryer as well as the motor.

6. The clothes dryer vent airflow system according to claim 5 wherein the dryer exhaust port includes an air velocity sensor that includes a spring-loaded hinge, and an on/off wire; wherein the on/off wire connects to the motor and turns on or off the motor depending upon the presence of clothes dryer exhaust being present; wherein the air velocity sensor pivots with respect to the spring-loaded hinge in order to open or close off the dryer exhaust port; wherein the air velocity sensor works as a baffle that rotates dependent upon whether clothes dryer exhaust is entering the dryer exhaust port; wherein the air velocity sensor rotates from a vertical position to a horizontal position; wherein an air velocity sensor catch is included in the inner surface of the dryer exhaust port, and limits the operational range of rotational movement of the air velocity sensor.

7. A clothes dryer vent airflow system comprising:

a fan housing with a dryer exhaust port configured to attach to a clothes dryer exhaust pipe of a clothes dryer;

said fan housing also includes an ambient air intake port that is configured to draw in ambient air and mix said ambient air with clothes dryer exhaust thereby lowering the overall temperature and forming a mixed air that is dispensed from the fan housing via a fan housing exhaust port;

wherein said fan housing exhaust port is configured to attach to a clothes dryer exhaust line that dispenses the mixed air elsewhere;

wherein the fan housing is a cylindrical-shaped body further defined with a first side and a second side as well as a peripheral surface;

wherein the first side of the fan housing includes the dryer exhaust port and a motor;

wherein the second side of the fan housing includes the ambient air intake port and the fan housing exhaust port;

wherein the dryer exhaust port, the ambient air intake port, and the fan housing exhaust port are cylindrically shaped protuberances that extend perpendicularly away from the first side and the second side, respectively;

wherein the motor is connected to an impeller that is located inside of the fan housing;

wherein the impeller is able to rotate about a horizontal axis in order to draw in air from both the dryer exhaust port and the ambient air intake port;

wherein the impeller mixes and accelerates air from the dryer exhaust port and the ambient air intake port, and dispenses the mixed air out the fan housing exhaust port;

wherein the clothes dryer exhaust is blown into the dryer exhaust port;

whereas ambient air is sucked into the ambient air intake port;

wherein the ambient air intake port includes a screen member that is used to screen the ambient air prior to entering the fan housing;

wherein the fan housing includes a stand member that is affixed to a bottom portion of the fan housing;

wherein the stand member is optionally provided in order to stabilize the fan housing adjacent to an existing clothes dryer;

wherein the dryer exhaust port is a cylindrically-shaped protuberance that extends from the first side of the fan housing;

wherein the dryer exhaust port includes a pressure sensor that is provided on an inner surface of the dryer exhaust port;

wherein the pressure sensor is used to insure that the clothes dryer exhaust pipe is secured and inserted an exhaust pipe depth into the dryer exhaust port;

wherein the dryer exhaust port has an internal diameter that is greater than or equal to a clothes dryer exhaust pipe outer diameter;

wherein the dryer exhaust port includes an air velocity sensor that includes a spring-loaded hinge, and an on/off wire;

wherein the on/off wire connects to the motor and turns on or off the motor depending upon the presence of clothes dryer exhaust being present;

wherein the air velocity sensor pivots with respect to the spring-loaded hinge in order to open or close off the dryer exhaust port;

wherein the air velocity sensor works as a baffle that rotates dependent upon whether clothes dryer exhaust is entering the dryer exhaust port;

wherein the air velocity sensor rotates from a vertical position to a horizontal position;

wherein an air velocity sensor catch is included in the inner surface of the dryer exhaust port, and limits the operational range of rotational movement of the air velocity sensor.

8. The clothes dryer vent airflow system according to claim 7 wherein a modified clothes dryer electrical plug is included, and is configured to connect to an electrical receptacle; wherein the modified clothes dryer electrical plug includes a circuit breaker that is provided in-line with at least two dryer plug leads in order to cut off electrical connectivity between the electrical receptacle and the clothes dryer when certain emergency situations arise; wherein a smoke detector is included on the inner surface of the dryer exhaust port in order to detect any smoke that may arise with burning lint that collects outside of the clothes dryer; wherein the smoke detector along with the pressure sensor are collectively wired to the circuit breaker via a sensor wire, and either of which may trip the circuit breaker in order to cut off electrical flow from the electrical receptacle to the clothes dryer; wherein the modified clothes dryer electrical plug includes a female electrical outlet, which is able to connect with a male plug of a motor electrical cord of the motor such that the modified clothes dryer electrical plug is able to supply electricity to both the clothes dryer as well as the motor.

* * * * *